United States Patent [19]

Jarrett et al.

[11] 4,117,819

[45] Oct. 3, 1978

[54] THRESHOLD CIRCUIT SUITABLE FOR USE IN ELECTRONIC IGNITION SYSTEMS

[75] Inventors: Robert B. Jarrett; Don W. Zobel, both of Tempe, Ariz.

[73] Assignee: Motorola, Inc., Schaumburg, Ill.

[21] Appl. No.: 735,472

[22] Filed: Oct. 26, 1976

[51] Int. Cl.[2] ..... F02P 9/00

[52] U.S. Cl. ..... 123/148 E; 307/363; 315/209 T

[58] Field of Search ..... 123/148 E; 323/22 T; 307/362, 363; 328/146; 330/13, 263; 315/209 T

[56] References Cited

U.S. PATENT DOCUMENTS

| | | | |
|---|---|---|---|
| 3,605,713 | 9/1971 | LeMasters et al. | 315/209 |
| 3,797,471 | 3/1974 | Schuette | 123/148 E |
| 3,872,323 | 3/1975 | Frederiksen et al. | 307/362 |
| 3,882,840 | 5/1975 | Adamian et al. | 123/148 E |
| 3,892,219 | 7/1975 | Preiser et al. | 315/209 T |
| 4,019,484 | 4/1977 | Mori | 315/209 T |

OTHER PUBLICATIONS

Walter G. Jung, "IC OP-AMP Cookbook," 1976, ©1974, p. 86, p. 512.

Millman and Halkias, "Electronic Devices and Circuits," 1967, p. 351.

Gagnon, Karwoski, "Complementary Output Stage Improves Op-Amp Response," Electronics,9-25-1972, p. 110.

McCaffrey, Brandt, "FET Input Reduces IC Op Amp's Bias and Offset," Electronics, 12/7/1970, pp. 85-88.

*Primary Examiner*—Charles J. Myhre
*Assistant Examiner*—Andrew M. Dolinar
*Attorney, Agent, or Firm*—Michael D. Bingham

[57] ABSTRACT

A variable dwell ignition system comprising a circuit responsive to changes in engine RPM for causing the dwell time of the ignition system to be varied accordingly. The circuit is adapted to be connected to a sensor coil to receive ignition timing signals developed thereacross which are generated in timed relationship to the engine operation. The circuit provides for changing the direct current (DC) level about which the ignition signals are generated such that a threshold level is varied. As the threshold level is varied the dwell time of the system is varied respectively.

8 Claims, 3 Drawing Figures

THRESHOLD CIRCUIT SUITABLE FOR USE IN ELECTRONIC IGNITION SYSTEMS

BACKGROUND OF THE INVENTION

In contemporary electronic ignition systems energy is stored in the primary winding of an ignition coil to develop, upon discharge of the coil, the necessary voltage across the secondary winding to provide spark to operate the engine. The energy level is a function of the amount of current flowing through the primary and the duration thereof prior to the time when the current is interrupted to discharge the coil. It is the object of all such ignition systems to develop sufficient energy in the coil, at the highest operating engine speed, to provide the necessary voltage to cause high energy sparking. High energy spark causes the engine to operate more efficiently which reduces pollutant emissions from the vehicle.

One such ignition system provides a variable dwell time (ratio of current on time to off time) as the engine RPM is varied. Thus, at higher engine RPMs the dwell time is regulated to be longer than at lower engine RPMs which ensures sufficient energy storage in the coil to generate a high energy ignition spark. At lower engine RPMs the dwell percent is reduced in order to minimize power dissipation in the ignition circuit.

As understood, a series of alternating ignition timing signals are generated across a sensor coil in timed relationship to the engine operation. For example, for an eight cylinder automobile, eight ignition timing signals are generated to complete one cycle of the engine operation. Each individual firing cycle comprises the negative half cycle portion and the positive half cycle portion of the timing signal. In the instant ignition system the ignition timing signals are symmetrically generated about an adjustable DC potential. By comparing the magnitude of the ignition signal generated to a fixed reference potential, a triggering signal can be produced when the magnitude of the ignition signal becomes greater than the reference potential to cause current to flow through the ignition coil to effect charging of the same. In response to the engine speed increasing, the level of the DC potential is increased which effectively causes the triggering signal to be generated earlier in the firing cycle to increase the dwell percent. In this fashion, at low engine RPMs the dwell time can be maintained below 10 percent of the total firing cycle while at higher engine RPMs the dwell time can be increased to approximately 75 percent of the firing cycle. Therefore, at higher engine RPMs high energy ignition sparking is insured while at lower engine RPMs minimum power dissipation is produced.

In order to symmetrically generate the timing signal about the aforesaid DC potential, the terminal of the sensor coil which is adapted to receive the DC potential must be terminated in a very low impedance. The larger in value that this termination impedance becomes, the more that the sensor coil is effectively degained. Degaining the sensor coil can cause a misspark condition at low engine rpms which is very undesirous. Moreover, if the generated ignition signal is not symmetrical about the DC potential, control of the initiation of current flow through the ignition coil cannot be provided.

The present invention overcomes the above problems in a unique manner by providing a high impedance termination to the source of DC potential while providing a low impedance termination to the sensor coil.

To provide a low impedance termination, the prior art system uses a low value resistor to terminate the sensor coil. This allows excessive current drain to occur, as the DC potential is increased to a maximum value, at high engine rpms. However the high impedance termination of the the present invention reduces current drain of the ignition system.

Moreover, because current drain is reduced by the present invention, under "load dump" conditions, which are specified by the automobile industry, power dissipation in the present ignition system can be greatly reduced which increases the reliability of the ignition system of the invention over the prior art as described hereinafter.

SUMMARY OF THE INVENTION

Accordingly it is an object of the present invention to provide an improved electronic ignition system.

Another object of the present invention is to provide a variable dwell ignition system suitable to be fabricated in monolithic integrated circuit form.

Still another object is to provide a threshold circuit suitable to be utilized in a variable dwell ignition system for causing the dwell time to be varied.

A further object of the invention is to provide a threshold determining circuit to cause the dwell time of an ignition system to be varied while minimizing current drain thereof.

The foregoing and other objects are met in accordance with the present invention by providing a threshold circuit suitable to be fabricated in monolithic integrated circuit form which is utilized in a variable dwell ignition system. The threshold circuit comprises an adjustable voltage supply circuit and an output comparator-amplifier. The adjustable voltage supply circuit includes an unity gain amplifier adapted to receive an applied DC voltage at an input terminal of which the magnitude is varied to cause the output of the amplifier to vary accordingly. The amplifier provides a high impedance input to the source of the applied DC voltage and a low output impedance at the output thereof. The output comparator-amplifier develops a zero temperature coefficient reference potential and is adapted to be connected at an input terminal to one terminal of the sensor coil of the ignition system. The output of the unity gain amplifier is adapted to be connected to the other terminal of the sensor coil such that as the output level from the unity gain amplifier is adjusted, by adjusting the applied input DC voltage level, the average value of the alternating ignition timing signal developed across the sensor coil is varied which varies the threshold level of the circuit. By varying the threshold level, the output comparator is caused to be rendered conductive sooner or later during the firing cycle, which causes the dwell time to be varied.

DETAILED DESCRIPTION OF THE EMBODIMENT

Figure 1:
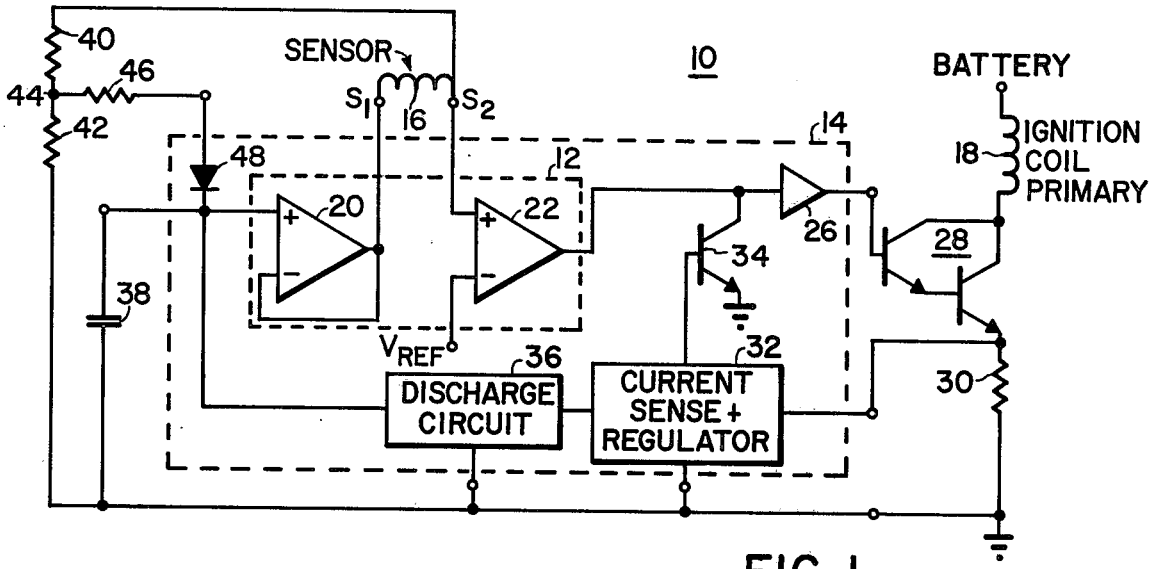
FIG. 1 illustrates in partial schematic and block diagram form an electronic variable dwell ignition system including the threshold circuit of the present invention.

Referring to the drawings, FIG. 1 illustrates electronic ignition system 10 which utilizes threshold circuit 12 of the present invention. The portion of the ignition system 10 shown within dashed outline 14 is suitable to be fabricated in monolithic integrated circuit form. Ignition system 10 is a variable dwell ignition system, the function thereof being known in the art. Briefly, however, in response to ignition timing signals (FIG. 2) developed across sensor coil 16, current is caused to flow through the primary winding of ignition coil 18. By controlling the time that the current is initiated through the primary winding, the dwell time (ratio of current on to off time) is varied. Thus, power dissipation of system 10 may be maintained minimal by reducing the dwell time at low engine rpm's and increasing the dwell time at high rpm's. Moreover, by varying the dwell time at high engine rpm's, sufficient energy can be developed in coil 18 to insure adequate spark to operate the engine.

More specifically, FIG. 1 illustrates in partial schematic and diagram form the components necessary for providing variable dwell operation. A magnetic pickup device (not shown) is positioned in the distributor of a vehicle which, as it rotates past sensor coil 16, develops an ignition timing signal illustrated in FIG. 2. Sensor coil 16 is connected between terminals S1 and S2 of threshold circuit 12, between amplifiers 20 and 22, respectively. The importance of this particular connection of sensor coil 16 will be discussed later. Generally, (FIG. 2A) as the magnitude of the timing signal, waveform 24, becomes greater than the magnitude of $V_{REF}$ (generated internally to chip 14) comparator amplifier 22 is rendered conductive which in turn renders amplifier 26 operative. When amplifier 26 is rendered operative, current is caused to flow into output amplifier stage 28 (which is provided off chip) which produces current flow through coil 18 and current sense resistor 30. Thus, energy is stored in the primary of coil 18. When the magnitude of the current from amplifier 28 to resistor 30 reaches a predetermined value, current sensor and regulator circuit 32 is activated to render transistor 34 conductive, (it otherwise being in a non-conductive state). Transistor 34 shunts input current away from amplifier 26 and reduces the output current therefrom such that current limiting occurs through output amplifier stage 28. As will be explained later, during current limiting when regulator circuit 32 is operative, discharge circuit 36 is caused to be operative which discharges capacitor 38. Previous to current limiting, capacitor 38 is charged to a predetermined value which produces a voltage, $V_C$, thereacross that is proportional to the magnitude of the ignition timing signal developed at terminal $S_2$. The resistor divider comprising resistors 40 and 42 provide a voltage which is proportionate to that developed at terminal $S_2$ at terminal 44. This voltage is utilized to charge capacitor 38 through resistor 46 and diode 48 during the positive half cycle of ignition timing signal 24 prior to current limiting.

Figure 2:
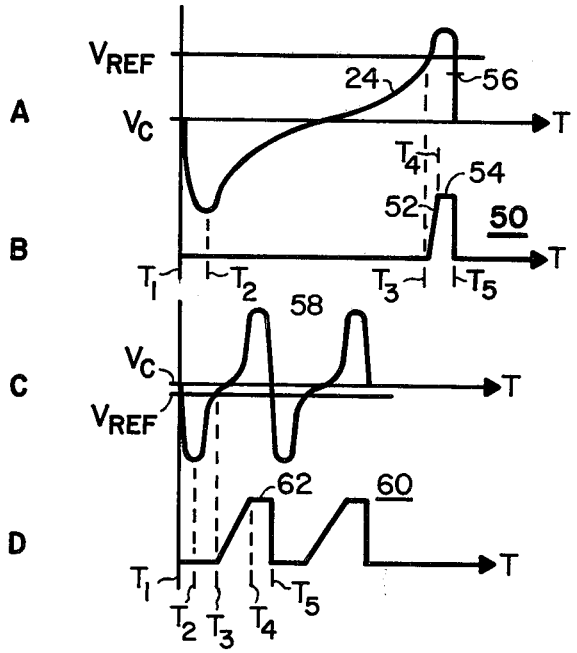
FIG. 2 illustrates waveforms useful for understanding the operation of the ignition system of FIG. 1.

Turning to FIG. 2, there is illustrated waveforms useful for explaining the variable dwell operation of ignition system 10. FIGS. 2A and 2B correspond to low engine speeds, e.g., idling speeds, and FIGS. 2C and 2D are representative of higher engine rpm's. In all cases, $V_{REF}$ is maintained substantially constant such that as the voltage at terminal $S_1$ is varied, the point at which amplifier 22 trips is caused to be varied. As is seen, the voltage developed across sensor coil 16 rides about the potential $V_C$, which is the magnitude of the voltage developed across capacitor 38. It is assumed that at low engine speeds $V_C$ is nearly at ground potential.

Referring to FIGS. 2A and 2B, a firing cycle is initiated at time $T_1$ when the timing signal goes negative. At $T_2$ waveform 24 reaches a peak negative value and begins going positive. At time $T_3$, the voltage developed across sensor coil 16 (which is applied at the input of amplifier 22) becomes equal to $V_{REF}$ rendering amplifier 22 conductive. As amplifier 22 is rendered conductive output stage 28 is also turned on. Current then begins to ramp up through coil 18 (portion 52 of waveform 50). At time $T_4$ the current through the ignition coil has reached a value which causes limiting as is shown by portion 54 of waveform 50. At $T_5$, another firing cycle is initiated and the voltage developed across sensor coil 16 again goes negative. Output amplifier 28 remains conductive until the voltage at terminal S2 decreases below the value shown by point 56 (FIG. 2A) which renders amplifier 22 non-conductive and shuts off output amplifier 28. Ignition coil 18 is then caused to be discharged as current ceases to flow therethrough and spark is produced. At low engine rpm's, the dwell time ($T_4$–$T_5$) of the system may be 10% or less of the total firing cycle.

As understood, at higher engine rpm it is desired to turn on output stage 28 sooner in the firing cycle so that current limiting will occur to insure adequate spark. From above, the ignition timing signal generated across sensor 16 is referenced to the voltage potential appearing at terminal $S_1$ and is developed symmetrically thereabout. By varying the value of $V_C$ the average value of the generated ignition timing signal can be caused to vary with respect to the voltage reference potential $V_{REF}$. As observed in FIGS. 2C and 2D, as $V_C$ is increased with respect to $V_{REF}$, the particular value at which the ignition signal (waveform 58) becomes greater than $V_{REF}$ occurs earlier in the firing cycle and causes current to flow through the ignition coil sooner. At $T_3$, the magnitude of waveform 58 becomes substantially equal to $V_{REF}$ and amplifier 22 becomes conductive. By charging capacitor 38 to a higher value, $V_C$ is increased which in turn causes amplifier 22 to be tripped sooner in the firing cycle. Subsequently, current limiting (portion 62 of waveform 60) occurs prior to the end of the firing cycle and a high energy voltage spark is provided upon discharge of the ignition coil (time $T_5$).

At higher engine speeds the magnitude of $V_C$ is controlled by the closed feedback loop comprising discharge circuit 36, resistors 40, 42, 46 and diode 48. At higher rpms, larger voltage magnitudes are generated across sensor coil 16 and the higher magnitude of the voltage picked off by the resistor divider comprising resistors 40 and 42 produces a current through diode 48 to charge capacitor 38. Thus, capacitor 38 is charged to a higher value as engine rpm is increased which develops a higher voltage thereacross, conversely capacitor 38 is discharged to lower the voltage developed thereacross at lower engine rpm. Hence, as the frequency of the firing cycle increases, output stage 28 is rendered conductive portionately sooner in the firing cycle time period. Subsequently, the dwell time is varied. In a steady state condition, i.e., constant engine rpm, the value of $V_C$ is held constant such that the dwell time remains constant. This results by discharging capacitor 38 through discharge circuit 36 the same amount that it is charged through diode 48. Discharge circuit 36 is rendered operative only during the current limit portion of the firing cycle in response to a control signal developed from current sense and regulator circuit 32. At higher rpm, ignition system 10 functions the closed loop system insures that capacitor 38 is maintained at a desired state of charge. For instance, during steady state operation if for some reason capacitor 38 is charged to a higher value then normal, during the subsequent firing cycle output stage 28 will be rendered conductive sooner such that current limiting occurs sooner which in turn discharges capacitor 38 longer until the steady state value is once again obtained.

As will be explained, several significant advantages are provided by ignition system 10 over contemporary variable dwell ignition systems. One such advantage is provided by amplifier 20 of threshold circuit 12 which functions as a variable potential supply circuit. Amplifier 20 is illustrated as a unity gain amplifier and provides both a high impedance termination to capacitor 38 and a low impedance termination to terminal $S_1$ of sensor coil 16.

As explained earlier, the dwell time is caused to vary in conjunction with the value of $V_C$ developed across capacitor 38. As $V_C$ increases, the point at which the value of the ignition timing signal (waveforms 24 and 58) becomes greater than $V_{REF}$ occurs sooner in the firing cycle. Thus, any variation in $V_C$ causes a corresponding variation in the dwell time. In the present invention, the voltage developed across capacitor 38 remains substantially constant until discharge because leakage current is maintained at a minimum due to the high input impedance developed at the input of amplifier circuit 20. Hence, the trip point of the ignition system of the present invention can be well defined.

Furthermore, by providing a low impedance termination to terminal $S_1$, the voltage derived across sensor coil 16 is caused to be symmetrically varied about the potential appearing at the output of amplifier 20 (illustrated as $V_C$ in FIG. 2). If the termination impedance increases, the sensor coil is caused to be degained which reduces the magnitude of voltage developed across the sensor coil. If the sensor coil is seriously degained there is the possiblity that at low engine rpm's the generated ignition timing signal would not reach a peak value sufficient to trip amplifier 22 and misfiring would occur in the engine. Furthermore, the more asymmetrical the ignition timing signal becomes about the reference potential $V_C$, the less accurate is the point that amplifier 22 is rendered conductive during a firing cycle. Hence the dwell time of the ignition system cannot be well defined. Therefore, it is very important to maintain a low output impedance at terminal $S_1$.

Figure 3:
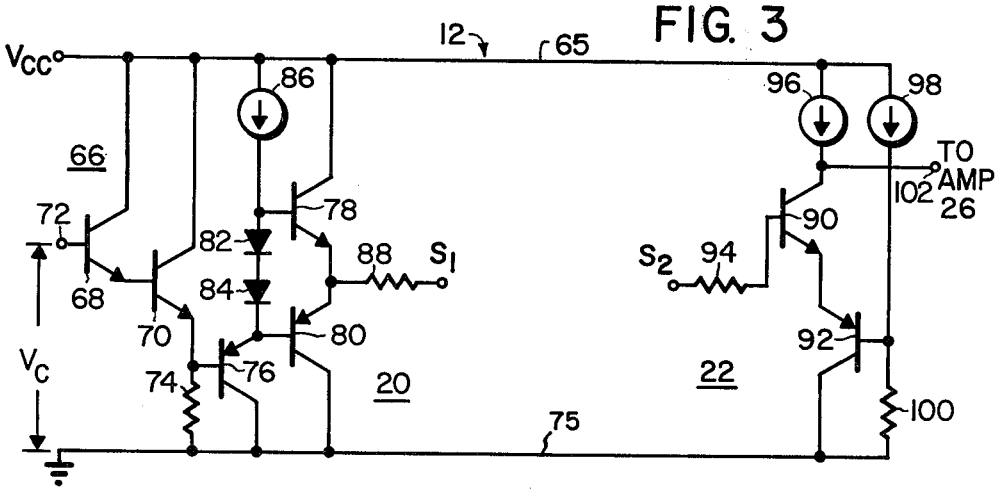
FIG. 3 illustrates in schematic form the threshold circuit of the present invention.

FIG. 3 illustrates threshold circuit 12 of the present invention which provides the advantages discussed above. Threshold circuit 12 which in preferred form is a portion of of IC chip 14 is adapted to receive a power supply voltage $V_{cc}$ supplied to power supply conductor 65. Amplifier 20 is illustrated as including input Darlington amplifier 66 comprised of transistors 68 and 70. The base electrode of transistor 68 is adapted to be connected to capacitor 38 at terminal 72 with the collectors of transistors 68 and 70 coupled to power supply conductor 65. The emitter of transistor 70 is coupled through resistor 74 to another power supply terminal 75 which may be at ground potential and also to the base of transistor 76, a PNP substrate transistor. Transistor 78 and 80 function as a push-pull output section. The base electrode of transistor 78 is coupled through current source 86 to power supply conductor 65 and to the emitter of transistor 76 through a pair of diodes 82 and 84. The base of transistor 80 is also connected to the emitter of transistor 76. The output of amplifier or voltage supply circuit 20 is coupled, via resistor 88, from the interconnected emitter electrodes of transistors 78 and 80 to terminal $S_1$ which is adapted to be connected thereat to sensor coil 16. The high input impedance provided to input terminal 72 is developed by "beta" multiplying the value of resistor 74, which in the preferred embodiment, is approximately equal to 3,000 ohms. This resistor also limits the current drain through Darlington amplifier 66 such that power dissipation is minimal. Similarly, a low output impedance is provided to terminal $S_1$ by dividing the value of resistor 74 by the betas of transistors 76 and 80 respectively.

In operation, the voltage potential appearing at terminal $S_1$ is nominally $2\phi$ (where $\phi$ is the base-to-emitter voltage drop of the bipolar transistors) at all times when the magnitude of $V_C$ is less than $2\phi$. If $\phi$ is approximately equal to 0.7 volts, then with $V_C$ less than 1.4 volts, transistor 68 and 70 are nonconductive and no current flows therethrough to resistor 74. In this state the voltage appearing at the emitter of transistor 78 and to terminal $S_1$ is essentialy 1.4 volts. However, when $V_C$ becomes greater than 1.4 volts, the voltage appearing at terminal $S_1$ will thereafter be substantially equal to $V_C$. In this state the voltage at terminal $S_1$ tracks $V_C$ for all values of $V_C$ greater than 1.4 volts. This can be observed in FIG. 3 by considering that the base-to-emitter voltages of all the bipolar transistors are substantially equal. Then, $V_C > 1.4$ volts, the voltage at terminal $S_1$ is;

$$V_{S1} = V_C - \phi_{68} - \phi_{70} + \phi_{76} + \phi_{84} + \phi_{82} - \phi_{78} \quad (1)$$

and $$V_{S1} = V_C \quad (2)$$

Amplifier 22 of threshold circuit 12 is illustrated as comprising NPN transistor 90 serially connected to PNP substrate transistor 92. The base electrode of transistor 90 is coupled, via resistor 94, to terminal $S_2$ which is adapted to be connected to the other terminal of sensor coil 16. The collector of transistor 90 is coupled through current source 96 to power supply conductor 65. The collector of transistor 92 is connected to the ground reference potential with the base electrode thereof connected between the junction of current source 98 and resistor 100, the later two components being series connected between power supply conductor 65 and ground potential. It should be noted that resistor 100 is equal to the resistor 74.

In operation, current source 98 establishes the reference voltage, $V_{REF}$, across resistor 100 which is applied at the base of transistor 92. Transistor 92 remains nonconductive until such time that the voltage potential applied at terminal $S_2$ reaches a value which is $2\phi + V_{REF}$. Because sensor coil 16 is connected between terminals $S_1$ and $S_2$, when $V_C$ is less than 1.4 volts, the voltage at terminal $S_1$ is equal to 1.4 volts and transistors 90 and 92 are rendered conductive when the voltage developed across sensor coil 16 becomes substantially equal to $V_{REF}$. This condition is illustrated in FIG. 2A. However, (FIG. 2C) when $V_C$ becomes greater than 1.4 volts, the voltage at terminal $S_1$ is substantially equal to $V_C$ such that the ignition timing signal rides thereabout and transistors 90 and 92 are rendered conductive sooner in the firing cycle. Therefore, as explained earlier, increasing the value of $V_C$ (with $V_{REF}$ being held constant) causes transistor 90 to be rendered conductive sooner. When transistor 90 is in the conductive state, amplifier 26, which is coupled thereto, is rendered conductive and energization current flows through ignition coil 18 as explained, supra.

By utilizing known techniques the voltage developed across resistor 100 can be made to have a zero temperature coefficient. Hence, if fabrication process variations are eliminated, the percentage dwell time at each respective engine rpm will remain substantially constant even though temperature conditions may vary.

The effect of process variations on the performance of threshold circuit 12 can be obviated by matching components of amplifiers 20 and 22. To eliminate such variations, substrate devices 76 and 92, as are current sources 86 and 96, are matched using known circuit techniques. Thus, the current supplied through diodes 82, 84 to transistor 76 is essentially equal in magnitude to the current through transistor 92. Because resistors 74 and 100 are identical in value, the relative values of the betas of transistors 76 and 92 are of no concern. Any voltage drop developed across resistor 74 due to the base current of transistor 76 will then be identical in value to the voltage developed across resistor 100 by base current from transistor 92. Hence, these variations are "common moded" between terminals S1 and S2 and do not effect the operation of the circuit.

In the operation of ignition system 10, threshold circuit 12 provides several significant advantages over contemporary variable dwell ignition systems. One such advantage is that the value of $V_C$ is held essentially constant during each firing cycle because of the high input impedance appearing at terminal 72. Hence, very little leakage current is developed which otherwise would cause discharging of capacitor 38. Thus, for a given engine rpm, the dwell time remains constant.

Ignition system 10 requires lower power drain than similar variable dwell ignition systems. The relatively large value of resistor 74 limits the current during through Darlington amplifier 16 by an order of magnitude over prior art ignition systems. For example, the drain current of ignition system 10 is less typically than 3 milliamperes, whereas that of the prior art is 30 milliamperes. Since the current drain of the instant circuit is quite minimal, power dissipation under "load dump" conditions is significantly less than that of the prior art which increases the reliability of ignition system 10 thereover.

Thus, what has been described above is an improved variable dwell ignition system utilizing a novel threshold circuit. The threshold circuit comprises an input variable voltage supplied circuit and an output amplifier having hysteresis.

What is claimed is:

1. In a variable dwell ignition system suitable for controlling the operation of an engine by receiving timing signals generated across a sensor coil in timed relationship to the operation of the engine to cause the duration of current flow through an ignition coil to be varied as engine speed is varied, the ignition system including a monolithic integrated threshold circuit coupled across the sensor coil which is responsive to the timing signals for producing a control signal that is utilized to vary the dwell time of the system, the improvement comprising:

the threshold circuit including (a) an input amplifier circuit comprising a Darlington amplifier and an unity gain amplifier, said Darlington amplifier having a high impedance input to which a variable direct current potential representative of the magnitude of the generated timing signals is applied thereto and an output, said unity gain amplifier having an input coupled to said output of said Darlington amplifier and a low impedance output which is coupled to a first terminal of the sensor coil such that the magnitude of the potential appearing at the first terminal of the sensor coil varies in accordance with said direct current potential being varied, the operating characteristics of said unity gain amplifier being a function of both fabrication process variations and variations in operating temperatures; and (b) a comparator circuit having an input coupled to a second terminal of the sensor coil for producing the control signal at an output thereof when the magnitude of the potential appearing at said input becomes greater then the magnitude of a predetermined reference potential, said comparator circuit having operating characteristics substantially identical with said unity gain amplifier such that the dwell time does not vary due to process and temperature variations.

2. The ignition system of claim 1 wherein said unity gain amplifier includes:

first impedance means coupled between said output of said Darlington amplifier and a reference operating potential;

first electron control means of a first conductivity type having first, second and control electrodes, said second electrode being coupled to said reference operating potential, said control electrode being coupled to said output of said Darlington amplifier, said first electron control means having electrical characteristics associated therewith;

first current source means coupled to a source of operating potential for supplying a predetermined current at the output thereof;

second electron control means coupled between said output of said first current source means and said first electrode of said first electron control means; and push-pull output means having first, second and output terminals, said first terminal being coupled to said output of said first current source means, said second terminal being coupled to said first electrode of said first electron control means and said output terminal being coupled to the output of said unity gain amplifier.

3. The ignition system of claim 2 wherein said second electron control means includes:

first diode means having anode and cathode electrodes, said anode electrode being coupled to said output of said first current source means; and second diode means having anode and cathode electrodes, said anode electrode being coupled to said cathode electrode of said first diode means, said cathode electrode being coupled to said first electrode of said first electron control means.

4. The ignition system of claim 2 wherein said comparator means includes:

second current source means coupled to said source of operating potential for supplying a predetermined current at an output thereof;

second impedance means coupled between said output of said second source means and said reference operating potential so that a reference bias potential is established thereacross, said second impedance means being matched with said first impedance means;

third electron control means of said first conductivity type having first, second and control electrodes, said control electrode being coupled to said impedance means, said second electrode being coupled to said reference operating potential, said third electron control means having electrical characteristics substantially matched to said electrical characteristics of said first electron control means; and fourth electron control of a second conductivity type means having first, second and control electrodes, said control electrode being coupled to said input of said comparator means, said first electrode being coupled to said first electrode of said third electron control means, said second electrode being coupled to said source of operating potential, to said output of said comparator means.

5. The ignition system of claim 4 wherein said comparator means includes third current source means coupled between said source of operating potential and said second electrode of said fourth electron control means, said third current source supplying a current of substantially equal magnitude as said current supplied by said first current source means.

6. A variable dwell ignition system responsive to applied alternating timing signals being developed across first and second terminals of a sensor coil in timed relationship with the operation of an engine for causing charging and discharging of an ignition coil to produce spark to operate the engine, comprising in combination:

output power means coupled to the ignition coil for drawing current through the ignition coil in response to a control signal being applied to an input of said output power means for charging the ignition coil, said output power means being rendered nonconductive in response to termination of said control signal such that the ignition coil is then caused to be discharged;

threshold circuit means having an input and output for producing said control signal at said output, the initiation of said control signal during the cycle of the applied timing signal being caused to be shifted in accordance with variations in the speed of the engine, said threshold circuit means including an amplifier means having an output coupled to the first terminal of the sensor coil and an input coupled to the input of the threshold circuit at which is applied a variable direct current potential for providing a direct current potential at said output the magnitude of which varies with variations in said applied variable direct current potential such that the instantaneous value of the alternating timing signal developed across the sensor coil is shifted accordingly, and comparator means having an input coupled to the second terminal of the sensor coil for producing said control signal at an output thereof when the magnitude of the alternating signal becomes greater than a predetermined reference value; and said amplifier means including;

(a) an input amplifier circuit having an input terminal connected to said input of said amplifier means, a bias terminal coupled to a source of operating potential, and an output terminal;

(b) first resistive means coupled between said output terminal of said input amplifier circuit and an operating reference potential;

(c) first electron control means of a first conductivity type having first, second and control electrodes, said control electrodes being coupled to said output terminal of said input amplifier circuit, said second electrode being coupled to said operating reference potential;

(d) first current source means for providing a predetermined current at an output thereof, said current source being coupled to said source of operating potential;

(e) second electron control means coupled between said output of said current source means and said first electrode of said first electron control means; and (f) a push-pull output section coupled between said source of operating potential and said operating reference potential including first and second inputs and an output, said first input being coupled to said output of said current source means, said second input being coupled to said first electrode of said first electron control means, said output being coupled to said output of said amplifier means.

7. The ignition system of claim 6 wherein said comparator means include: third electron control means of a second conductivity type having first, second and control electrodes, said control electrode being coupled to said input terminal of said comparator means;

fourth electron control means of said first conductivity type having first, second and control electrodes, said first electrode being coupled to said first electrode of said third electron control means, said second electrode connected to said termination potential;

second current source means coupled between said source of operating potential and said second electrode of said third electron control means;

third current source means connected between said source of operating potential and said control electrode of said fourth electrode control means; and second resistive means connected between said control electrode of said fourth electron control means and said operating reference potential.

8. The ignition system of claim 6 further including:

capacitive means connected between said input of said threshold circuit means and said operating reference potential for providing said variable dc potential;

circuit means coupled between the second terminal of the sensor coil and said input terminal of said threshold circuit means for charging said capacitive means in response to said timing signals;

current sense means responsive to said current conducted-through said output power means reaching a predetermined value for providing another control signal to cause said current to be limited at said value and for simultaneously providing an additional control signal; and discharge circuit means responsive to said additional control signal from said current sense means for discharging said capacitive means during the current limiting state of the ignition system.

* * * * *